US005311267A

United States Patent [19]

Bean

[11] Patent Number: 5,311,267

[45] Date of Patent: May 10, 1994

[54] METHOD AND APPARATUS FOR SUPPORTING PHOTORECEPTIVE BELT AND COPY PAPER TO REDUCE TRANSFER DELETIONS

[75] Inventor: Lloyd F. Bean, Rochester, N.Y.

[73] Assignee: Xerox Corporation, Stamford, Conn.

[21] Appl. No.: 993,755

[22] Filed: Dec. 21, 1992

[51] Int. Cl.[5] ..... G03G 15/16

[52] U.S. Cl. ..... 355/271; 355/212

[58] Field of Search ..... 355/212, 271-276

[56] References Cited

U.S. PATENT DOCUMENTS 4,371,251 2/1983 Morse .
4,624,549 11/1986 Katoh .
4,839,673 6/1989 Kegelman et al. ..... 355/276 X
4,947,214 8/1990 Baxendell et al. ..... 355/274
5,048,813 9/1991 Wierzewski et al. ..... 271/98
5,049,905 9/1991 Tomoyori et al. ..... 355/273 X
5,081,500 1/1992 Snelling ..... 355/273

*Primary Examiner*—R. L. Moses
*Attorney, Agent, or Firm*—Fay, Sharpe, Beall, Fagan, Minnich & McKee

[57] ABSTRACT

Transfer deletions are reduced in a xerographic copy machine by imparting a curvilinear shape to the copy paper as it passes through at least a portion of a transfer zone. In a first embodiment, a fixed shoe constrains movement of a photoreceptor belt thereover, while a second preferred arrangement uses a roller to impart the curvilinear shape to the paper. In still another arrangement, a baffle that feeds the copy paper to the transfer zone is oriented with an existing roller structure to shape the paper as desired, and the baffle may be movable to vary the shape as the paper moves into the transfer zone.

25 Claims, 2 Drawing Sheets

METHOD AND APPARATUS FOR SUPPORTING PHOTORECEPTIVE BELT AND COPY PAPER TO REDUCE TRANSFER DELETIONS

BACKGROUND OF THE INVENTION

This invention relates to an electrophotographic printing machine, and more particularly to a photoreceptor belt and copy paper support arrangement that reduces transfer deletions.

This invention is particularly applicable to high speed xerographic copy reproduction machines. These machines conventionally include an endless xerographic photoreceptor belt that travels through a closed loop path from one station to another. For example, the belt is corona charged at a first station and exposed to an image at a second station. The image is developed at a third station and then proceeds to a fourth station generally known as a transfer station before it is precleaned and the remaining toner removed from the belt for use in the process again.

As is well known in the art, copy sheets are fed from one or more trays and advanced through a copy sheet transport path for operative engagement with the photoreceptor belt at the transfer station. This invention also contemplates receiving paper from a duplex tray where a copy sheet has already passed through the transfer station for imaging on one side, temporarily stored in a duplex tray, and subsequently fed through the transfer station a second time in an inverted state so that the opposite side of the copy sheet is imaged.

In reprographic systems of this type, transfer deletion is often a problem. That is, insufficient contact between the copy sheet and the photoreceptor belt results in incomplete or insufficient transfer of the image from the belt to the sheet. As is known in the art, this image transfer occurs at a transfer station where the paper is charged to receive the image from the photoreceptor belt. Intimate contact between the copy sheet and the photoreceptor belt at the transfer station allows the toner to pass from the photoreceptor to the copy sheet.

Insufficient contact between the photoreceptor belt and the copy sheet can result for various reasons. A primary cause of insufficient contact and transfer deletion is associated with imperfections in the copy sheet, wrinkles or cockles in duplex sheets that have been printed on one side, or puckers and pockets associated with the copy sheet or photoreceptor belt. Non-ideal transfer of xerographic images from belt photoreceptors to the copy paper are, therefore, often due to paper damage. Heating and cooling associated with the fusing process, where the image previously transferred to the copy paper is heated for bonding with the paper, may result in non-uniform moisture content in the copy paper. This, of course, is associated with duplex copying where the copy paper passes through the process twice to receive images on opposite sides of the paper. Damage may also be associated with the paper handling system, such as the drive and cross feed rolls. Again, the paper can become wrinkled or cockled thereby resulting in less than desirable transfer of the image.

At one time the use of substantially planar transfer stations was encouraged for different reasons. For example, heavier grade paper has a tendency to separate from the photoreceptor belt, particularly at the trailing edge, resulting in insufficient transfer at that area. In an effort to address this perceived problem, planar transfer zones were encouraged to assure that the entire copy paper received the image from the belt. Nevertheless, it has been observed that more severe transfer deletion problems are associated with planar or flat transfer stations.

Accordingly, it has been deemed desirable to overcome transfer deletion problems, particularly those associated with copy sheet damage.

SUMMARY OF THE INVENTION

The present invention contemplates a new and improved method and apparatus for reducing transfer deletion problems associated with copy sheet damage in a simple and economical manner.

According to the present invention, an electrophotographic printing machine that transfers an image at a transfer work station or zone incorporates means for imparting a curvilinear shape to at least one of the photoreceptor belt and the copy sheet through at least a portion of the transfer zone.

According to a more limited aspect of the invention, the curvilinear imparting means includes a stationary guide shoe that has a smooth, low friction surface that supports the photoreceptor belt.

According to another aspect of the invention, the imparting means includes a roller that supports the photoreceptor belt.

In still another modified arrangement, the imparting means includes means for moving a baffle associated with copy paper conveying means relative to the belt to vary the angle of incidence therewith.

According to a preferred method, a first portion of the copy sheet is fed from the paper baffle toward the photoreceptor belt. The belt and paper baffle are oriented to define a curvilinear path through at least a portion of the transfer station and the leading edge of the copy sheet is tacked to the belt.

According to another aspect of the method, the paper baffle is moved during the feeding of the copy sheet.

A primary advantage realized by the subject apparatus and method is a decrease in transfer deletion problems.

Still other advantages and benefits are offered by the subject invention.

BRIEF DESCRIPTION OF THE DRAWINGS

For a better understanding of the invention, as well as other objects and further features thereof, reference is made to the following drawings.

DETAILED DESCRIPTION OF THE PREFERRED EMBODIMENTS AND METHOD

Figure 1:
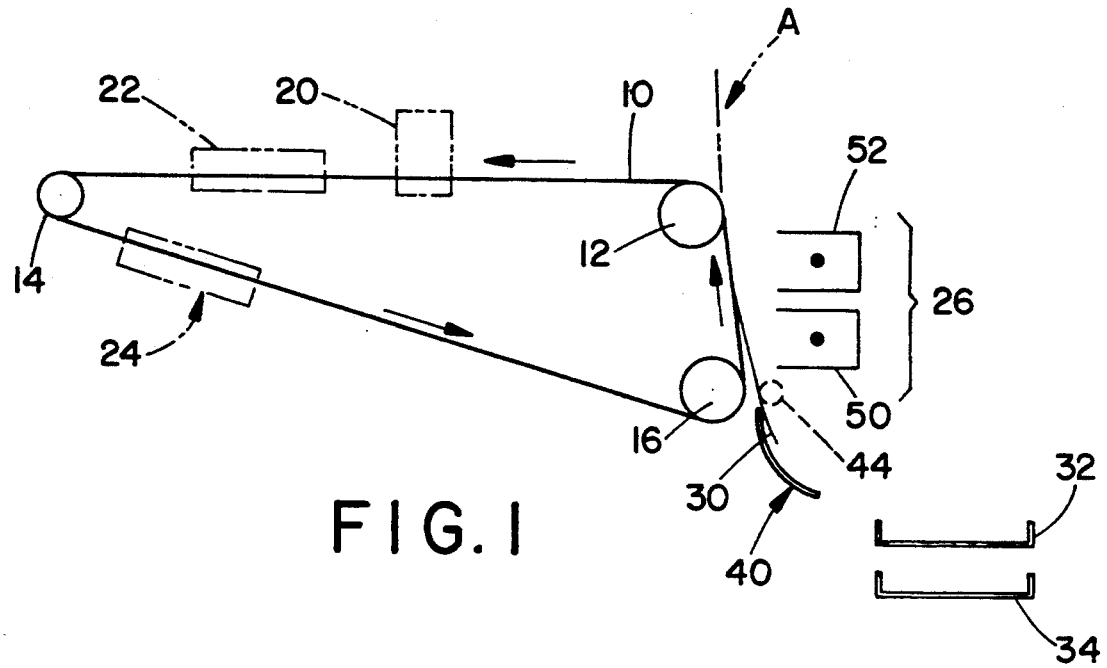
FIG. 1 is a schematic representation of a prior art arrangement particularly highlighting the transfer zonc in a xerographic apparatus and method.

Referring now to the drawings wherein the showings are for purposes of illustrating the preferred embodiments and method of the invention only and not for purposes of limiting same, the FIGURES show one portion of a xerographic copy reproduction machine A.

Details of the overall xerographic process and printing machines of this general type are well known so that discussion of those overall features herein is deemed unnecessary to a full and complete understanding of the invention. These features are described in greater detail in commonly assigned U.S. Pat. No. 5,048,813, which is incorporated herein by reference.

More particularly, the copy machine A includes an endless xerographic photoreceptor belt 10 that travels around a closed loop path, herein illustrated as a generally right angle triangular path. The belt is schematically illustrated as traveling in a counterclockwise direction about a series of three rollers 12, 14, 16 and various stations or zones are schematically represented along this closed loop path. The processing stations employed in the copy machine are well known and will only be discussed briefly herein.

The different stations perform the various steps in the xerographic process. For example, along the generally horizontal path illustrated between rollers 12 and 14, the belt is corona charged as schematically represented by station 20. As the belt proceeds leftwardly along the horizontal path, image exposing occurs at work station 22. Due to particular properties of the belt, the image is electrostatically formed on the surface of the belt. The belt then proceeds around the roller 14, and extends in a downward and rightward direction at an angle toward roller 16. Image developing occurs along this portion of the path as represented by work station 24 occurs. Toner is applied to the belt at this station, electrostatically adhering thereto and forming a real image in toner on the belt.

Next, the belt proceeds around roller 16 and generally vertically upward through transfer zone or station 26. At the transfer zone, and as its name implies, the toner image is transferred from the photoreceptor belt to copy paper. Specifically, copy paper 30 is provided from one or more trays 32, 34. Although additional paper transport means of conventional construction are used, an input paper baffle 40 directs the copy paper as received from the trays in a generally vertical manner so that it proceeds in a parallel, vertical relation to the belt through the transfer zone.

A leading edge 42 of the paper is tacked to the belt. In some arrangements, an additional roller 44 is disposed adjacent roller 16 to define a nip through which the paper 30 is advanced. Thus in typical design arrangements, as the paper advances toward the transfer zone it is generally planar in configuration and in intimate contact with the surface of the photoreceptor belt. After contacting the photoreceptor belt, the copy sheet is advanced to the transfer zone where transfer coronode 50 causes the transfer of toner from the belt to the copy sheet. The sheet is maintained against the photoreceptor during this transfer process and eventually the leading edge of the sheet reaches, or is advanced beneath, detack coronode 52. Transfer of the image from the belt to the copy paper is thus completed between the coronodes so that as the belt proceeds around roller 12, the copy paper, now carrying the toner image, can proceed to subsequent work stations where the image is fused thereto. The 90° turn of the belt about roller 12 also enhances separation between the belt and copy paper.

Figure 4:
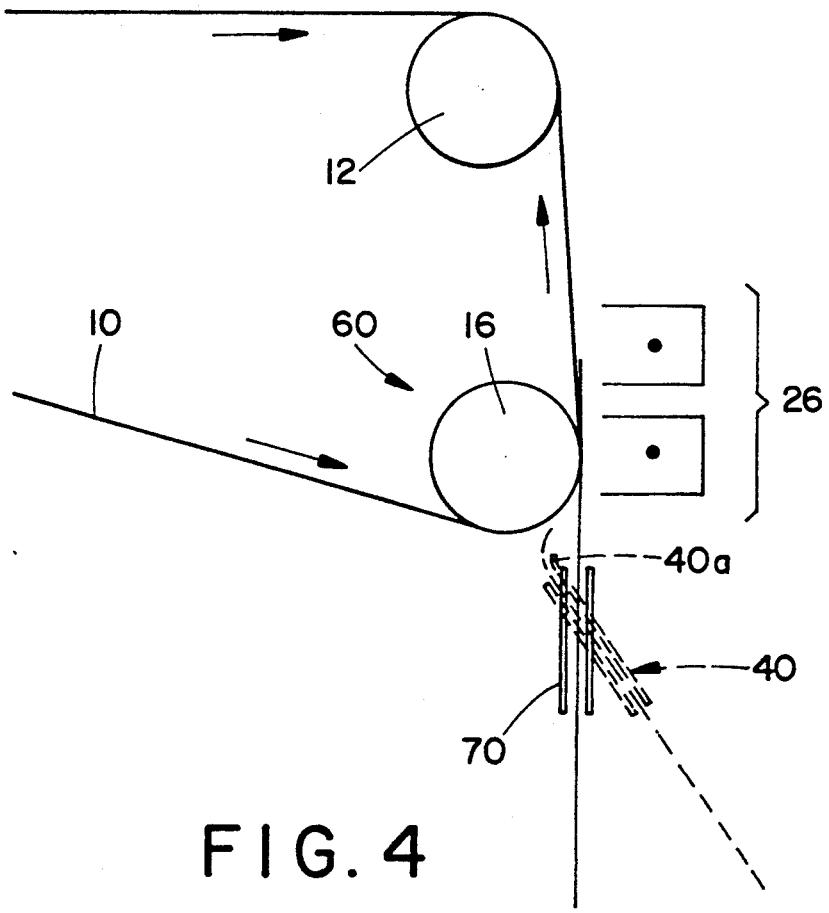
Figure 2:
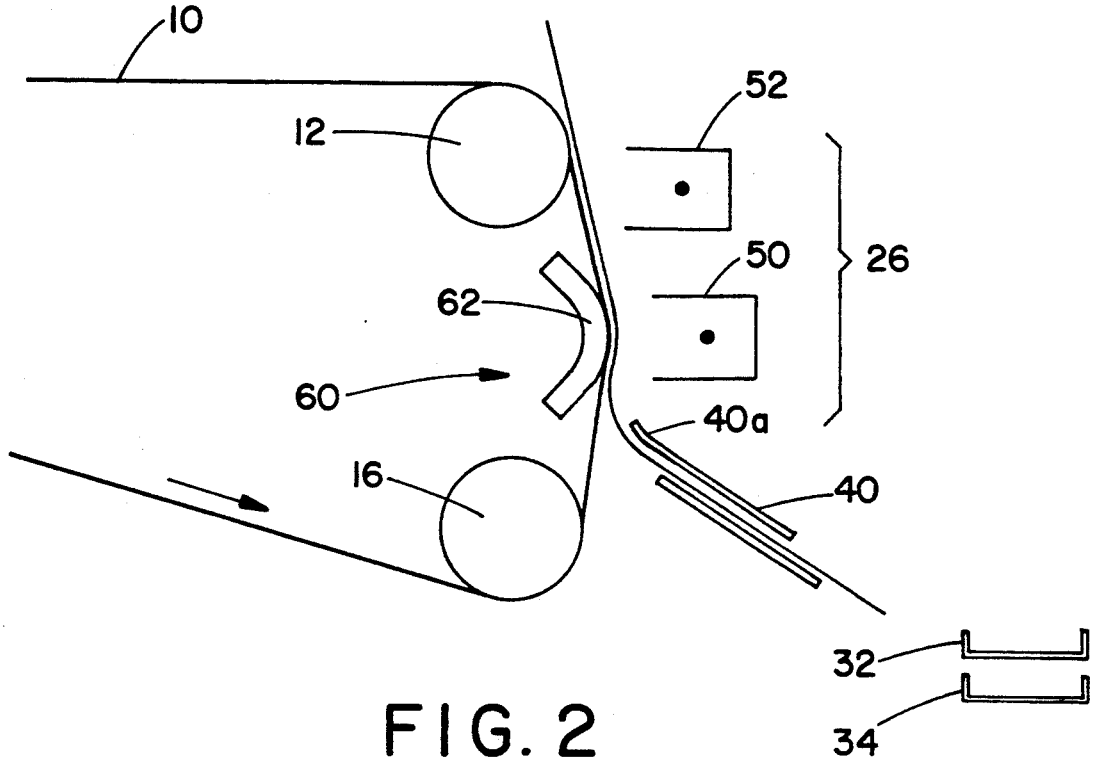
FIG. 2 is an enlarged, detail schematic view of a modified apparatus incorporating the teachings of the subject invention.
Figure 3:
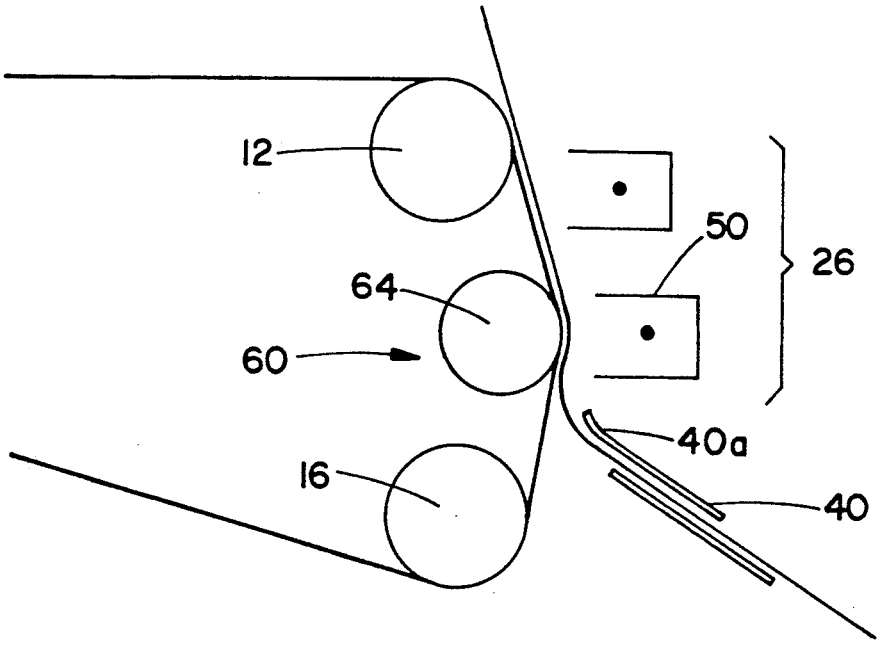
FIG. 3 is a view similar to that of FIG. 2 illustrating another preferred arrangement of the subject invention; and, FIG. 4 shows still another preferred arrangement in accordance with the teachings of the subject invention.

To coordinate the following description and relate it to the above general discussion, like numerals in FIGS. 2–4 will refer to like elements, while new numerals will identify new elements. More particularly, and as shown in FIG. 2, the subject invention modifies the transfer zone by incorporating means for imparting a curvilinear shape to the copy sheet as it proceeds through the transfer zone. Paper is supplied from a tray 32 or 34 and eventually enters baffle 40. As shown, the baffle 40 has a radiused end **40*a* disposed on one of the baffle walls adjacent the photoreceptor belt 10. It will be understood that this radiused conformation of the baffle wall facilitates the intent of the subject invention as will become apparent below. The baffle is more sharply angled relative to the generally vertical direction between rollers 16 and 12. As the belt proceeds in a counterclockwise direction, the leading edge of the copy paper contacts the belt and is advanced toward transfer coronode 50**.

Preferably, at the input of the transfer zone 26, the means 60 for imparting a curvilinear shape is disposed adjacent the transfer coronode. In the preferred embodiment of FIG. 2, the imparting means is defined by a stationary guide shoe 62. The guide shoe projects rightwardly or out of the plane defined between the tangents of rollers 12 and 16 so that the belt is constrained to pass over the guide shoe. This arrangement assures that the copy paper abutting thereagainst travels in a curvilinear relationship beneath the transfer coronode 50. Thus, as the leading edge of the copy paper is passing beneath coronode 50, a trailing edge of the paper has a reverse curve imparted to it since it is still contained in the baffle 40. The curvilinear shape or configuration imparted to the paper removes the pockets, wrinkle, or cockles and enhances the transfer of the image from the photoreceptor belt to the copy paper. The xerographic process then continues essentially as described above whereby the copy sheet is advanced beneath the detack coronode and subsequently separated from the photoreceptor belt as the belt proceeds around roller 12.

In FIG. 3, the transfer guide shoe 62 defining the curvilinear imparting means is substituted with a roller 64. The roller 64 extends outwardly from the generally vertical tangent between rollers 12 and 16, again, urging the paper sheet to adopt the generally curvilinear shape of the belt as it proceeds through the transfer zone 26. Preferably, this curvilinear shape is imparted to the belt and paper as it proceeds beneath the transfer coronode 50. Moreover, retention of the trailing edge of the paper in baffle 40 imparts a reverse curve or generally S-shape contour to the paper, although any curvilinear contour can be used. Again, this curvilinear shape provides a more intimate contact between the paper and the photoreceptor belt, removing wrinkles and cockles associated with imperfections in the paper and thereby increasing image transfer or quality of image transfer from the belt to the paper.

With continued reference to the embodiments of FIGS. 2 and 3, and additional reference to FIG. 4, another preferred arrangement is shown. As is apparent, the transfer zone 26 is more closely disposed to roller 16. In fact, a vertical tangent to roller 16 defines the beginning of the transfer zone. Thus, the baffle 70 is disposed at an area below the roller 16, as opposed to its position intermediate rollers 16 and 12 in the FIGS. 2 and 3 embodiments. Further, the photoreceptor belt 10 follows a truer vertical path as it proceeds between the rollers 16 and 12. The guide shoe 62 and roller 64 are not incorporated into this arrangement so that the closed loop is generally linear between the rollers.

The curvilinear imparting means 60 in this embodiment is, in part, defined by the orientation of the baffle relative to support roller 16. Due to the counterclockwise movement of the belt about roller 16, and the angular orientation of baffle 70, the copy paper has a curvilinear shape imparted to it as it exits the baffle and proceeds around the surface of roller 16 in contact with the belt 10. The transfer coronode 50 is generally disposed at the 3 o'clock position of support roller 16, where the copy paper and photoreceptor belt are still traveling through a curvilinear path.

The paper baffle 70 is preferably movable relative to the belt to vary its angular orientation with respect to fixed roller 16. In this manner, after initial tacking of the copy paper to the belt, the S-shaped configuration of the copy paper can be increased to remove the cockles, wrinkles, etc. therefrom.

It will be understood that the preferred arrangement of FIG. 4 may also be used in conjunction with the structures of FIGS. 2 and 3 if so desired. Thus, the curvilinear imparting means would incorporate a guide shoe or roller in combination with a movable baffle to increase the effect of the cockle reducing S-shape in the paper copy.

The invention has been described with reference to the preferred embodiments. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. In an electrophotographic printing machine having a photoreceptor belt passing through an inlet end of a transfer zone, and copy sheet transport means for supplying a copy sheet to the inlet end of the transfer zone, the improvement for reducing transfer deletions by reducing damage in the copy sheet at the transfer zone characterized by:

a photoreceptor belt guide member located at the transfer zone to cause the photoreceptor belt to travel a curvilinear path as it moves through the transfer zone; and, sheet guide means associated with the copy sheet transport means operative in conjunction with the belt guide member to impart a curvilinear shape to the copy sheet entering the inlet end and passing through the transfer zone, the sheet guide means including a movable baffle member located upstream of the inlet end of the transfer zone for imparting the curvilinear shape to the copy sheet.

2. The improvement of claim 1 further including an idler roller adjacent the photoreceptor belt and defining a nip therewith at the inlet end of the transfer zone, the copy sheet transport means arranged for supplying copy sheets to the nip and the baffle member located immediately upstream of the nip relative to the direction of copy paper transport.

3. The improvement of claim 1 wherein the photoreceptor belt guide member comprises a roller over which the photoreceptor belt is constrained to travel during movement through the transfer zone.

4. The improvement of claim 3 wherein the roller is an idler roller.

5. The improvement of claim 3 wherein the roller has a smooth low friction surface.

6. The improvement of claim 1 wherein the photoreceptor belt guide member comprises a guide shoe over which the photoreceptor belt is constrained to travel during movement through the transfer zone.

7. The improvement as defined in claim 1 wherein control means is provided for moving the baffle in timed relationship with the entry of copy sheets into the inlet end of the transfer zone.

8. A method of operating an electrophotographic copy machine having a photoreceptor belt that travels along a predetermined work path, a paper baffle supplying a copy sheet, and a transfer zone defined along the work path having an input end that receives the copy sheet from the paper baffle for travel along the work path, the method comprising the steps of:

feeding a first portion of the copy sheet from the paper baffle toward the photoreceptor belt upstream from the input end and along a first angle of incidence with the belt;

orienting the photoreceptor belt and paper baffle by moving the paper baffle during the feeding step to a displacement position having a second angle of incidence with the photoreceptor belt to define a curvilinear path through at least a portion of the transfer zone; and tacking a leading edge of the copy sheet to the belt.

9. The method according to claim 8 wherein the paper baffle moving step includes the step of displacing the paper baffle to the displacement position substantially immediately after the copy sheet leading edge is tacked to the belt.

10. The method according to claim 8 wherein the orienting step includes the step of advancing the photoreceptor belt around a roller adjacent the input end of the transfer zone to impart a curvilinear shape to the copy sheet.

11. The method according to claim 8 wherein the orienting step includes the step of advancing the photoreceptor belt over a guide shoe during movement through the transfer zone.

12. In an electrophotographic printing machine having a photoreceptor belt passing through an inlet end of a transfer zone, and copy sheet transport means for supplying copy sheets to the inlet end of the transfer zone, the improvement for reducing transfer deletions by reducing damage in the copy sheets at the transfer zone characterized by:

a photoreceptor belt guide member located at the transfer zone to cause the photoreceptor belt to travel a curvilinear path as it moves through the transfer zone wherein the photoreceptor belt guide member comprises a stationary guide shoe over which the photoreceptor belt is constrained to travel during movement through the transfer zone; and, sheet guide means associated with the copy sheet transport means operative in conjunction with the belt guide member to impart a curvilinear shape to the copy sheets entering the inlet end and passing through the transfer zone.

13. The improvement of claim 12 wherein the guide shoe has a smooth, low friction surface.

14. The improvement as defined in claim 12 wherein the guide shoe is provided with a smooth, low friction surface.

15. A method of operating an electrophotographic copy machine having a photoreceptor belt that travels along a predetermined work path, a paper baffle supplying a copy sheet, and a transfer zone defined along the work path having an input end that receives the copy sheet from the paper baffle for travel along the work path and an outlet end where transfer of an image from the photoreceptor belt to the copy sheet has been completed, the method comprising the steps of:

feeding a first portion of the copy sheet from the paper baffle toward the photoreceptor belt upstream from the input end and along a first angle of incidence with the belt;

orienting the photoreceptor belt and paper baffle to define a fixed curvilinear path from the inlet end to the outlet end of the transfer zone; and tacking a leading edge of the copy sheet to the belt.

16. The method according to claim 15 wherein the orienting step includes the step of moving the paper baffle during the feeding step to a displacement position having a second angle of incidence with the photoreceptor belt.

17. The method according to claim 16 wherein the paper baffle moving step includes the step of displacing the paper baffle to the displacement position substantially immediately after the copy sheet leading edge is tacked to the belt.

18. The method according to claim 15 wherein the orienting step includes the step of advancing the photoreceptor belt over a guide shoe during movement through the transfer zone.

19. The method according to claim 18 wherein the orienting step includes the step of moving the paper baffle during the feeding step to a displacement position having a second angle of incidence with the photoreceptor belt.

20. An apparatus for reducing image deletion problems associated with paper damage, the apparatus comprising:

a photoreceptor belt that travels through a predetermined work path;

a copy sheet baffle having an outlet disposed adjacent the work path;

a transfer zone defined along the work path at a region downstream of the baffle outlet; and means for imparting a curvilinear shape to the copy sheet through at least a portion of the transfer zone, wherein the curvilinear imparting means includes a stationary guide shoe over which the belt passes.

21. The apparatus as defined in claim 20 wherein the guide shoe has a smooth low friction surface that supports the photoreceptor belt.

22. The apparatus as defined in claim 20 wherein the curvilinear imparting means includes means for moving the baffle relative to the photoreceptor belt to vary the angle of incidence therewith.

23. The apparatus as defined in claim 20 wherein the curvilinear imparting means includes a roller that supports the photoreceptor belt.

24. The apparatus as defined in claim 23 wherein the roller is a smooth low friction non-drive roller.

25. The apparatus as defined in claim 23 wherein the curvilinear imparting means includes means for moving the baffle relative to the photoreceptor belt to vary the angle of incidence therewith.

* * * * *